US005853844A

United States Patent [19]

Wen

[11] Patent Number: 5,853,844

[45] Date of Patent: Dec. 29, 1998

[54] RUBBER PAD CONSTRUCTION WITH RESILIENT PROTRUSIONS

[76] Inventor: Keith Wen, 8F, No. 156-2, Sec. 1, Chuang-Ching Rd., Tao-Yuan City, Taiwan

[21] Appl. No.: 862,622

[22] Filed: May 23, 1997

[51] Int. Cl.[6] ..... B32B 3/30

[52] U.S. Cl. ..... 428/119; 5/719; 5/944; 36/28; 36/32 R; 36/35 R; 36/59 A; 36/114; 52/177; 428/120

[58] Field of Search ..... 428/119, 120; 36/28, 35 R, 32 R, 59, 114; 5/944, 719; 52/177

[56] References Cited

U.S. PATENT DOCUMENTS 3,251,076 5/1966 Burke ..... 428/119
4,754,559 7/1988 Cohen ..... 36/28
5,353,523 10/1994 Kilgore ..... 36/28
5,544,431 8/1996 Dixon ..... 36/28

*Primary Examiner*—Nasser Ahmad
*Attorney, Agent, or Firm*—Ladas & Parry

[57] ABSTRACT

A rubber pad construction is adapted for use in making a shoe sole, a shoe pad, a face layer of a table-tennis paddle, a shell of a ball, etc. The rubber pad construction includes a substrate, and a plurality of first and second protrusions which extend outwardly from one side of the substrate at intervals. The first protrusions are thinner and higher than the second protrusions to provide more flexibility. The second protrusions have more bearing ability than the first protrusions. The rubber pad construction provides desirable shock-absorbing and rebounding qualities.

3 Claims, 7 Drawing Sheets

RUBBER PAD CONSTRUCTION WITH RESILIENT PROTRUSIONS

BACKGROUND OF THE INVENTION

1. Field of the Invention

This invention relates to a rubber pad, more particularly to a rubber pad construction having resilient protrusions.

2. Description of the Related Art

Rubber pads with resilient protrusions are widely used as shoe pads and shoe soles. Referring to FIGS. 1 and 2, a conventional shoe sole 10 is shown to have a plurality of tubular members 11 which project from the surface thereof for providing shock-absorbing and load bearing effects. In this shoe sole 10, when thinning the walls of the tubular members 11, the shock-absorbing effect is increased while elasticity or rebounding effect is decreased. It is difficult to have both the shock absorbing and the rebounding characteristics maintained at a desirable level with such resilient protrusions. Rubber pads with small protrusions are also used for covering two striking faces of a wooden table-tennis paddle for imparting elastic property. A sponge layer is provided between the wooden board and the rubber pad so as to provide a shock-absorbing effect since the rubber pad is inefficient for shock absorbing.

SUMMARY OF THE INVENTION

The main object of the present invention is to provide a rubber pad construction having desirable shock-absorbing and load bearing or rebounding qualities.

According to this invention, a rubber pad construction is adapted for use in making a shoe sole, a shoe pad, a face layer of table-tennis paddle, a shell of a ball, etc. The rubber pad construction includes a substrate, and a plurality of first and second protrusions which extend outwardly from one side of the substrate at intervals. The first protrusions are thinner and higher than the second protrusions to provide more flexibility. The second protrusions have more load bearing ability than the first protrusions. The first protrusions are first deformed easily due to their thinner and higher peripheral walls, thereby providing a shock-absorbing quality. The second protrusions, which are subsequently depressed, can bear against the pressure, thereby preventing the first protrusions from flexing excessively or yielding and providing a good rebounding effect.

BRIEF DESCRIPTION OF THE DRAWINGS

Other features and advantages of the present invention will become apparent in the following detailed description of preferred embodiments of the invention, with reference to the accompanying drawings, in which.

DETAILED DESCRIPTION OF THE PREFERRED EMBODIMENTS

The rubber pad construction of the present invention can be used for making a shoe sole, a shoe pad, a face layer of a table-tennis paddle, a shell of a basketball, etc. The rubber pad can be made of natural rubber or synthetic rubber.

Figure 1:
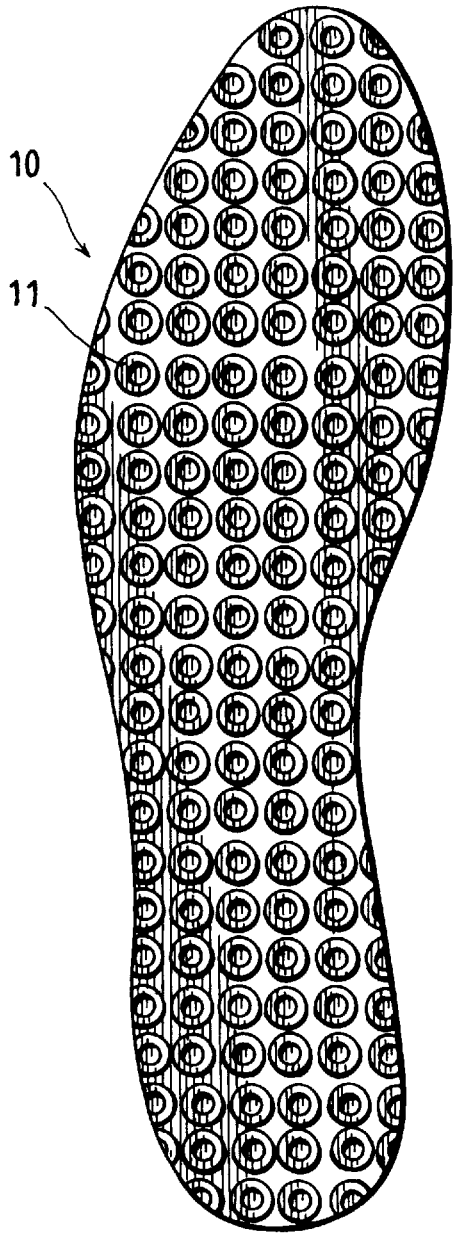
FIG. 1 (PRIOR ART)
FIG. 1 is a top view of a conventional outsole.
Figure 2:
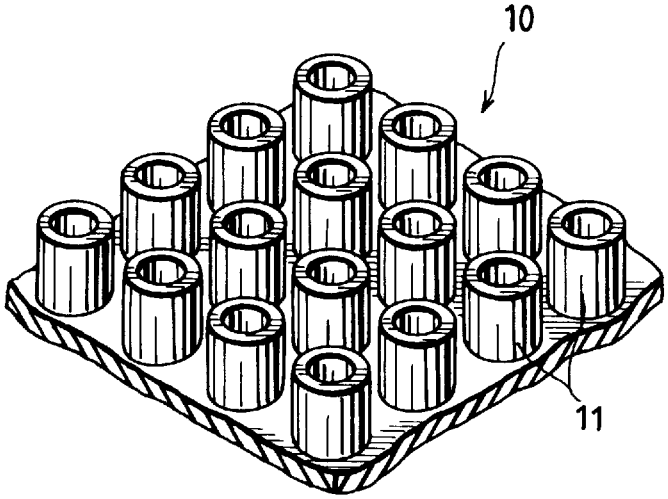
FIG. 2 (PRIOR ART)
FIG. 2 is a perspective view of a portion of the conventional outsole.
Figure 3:
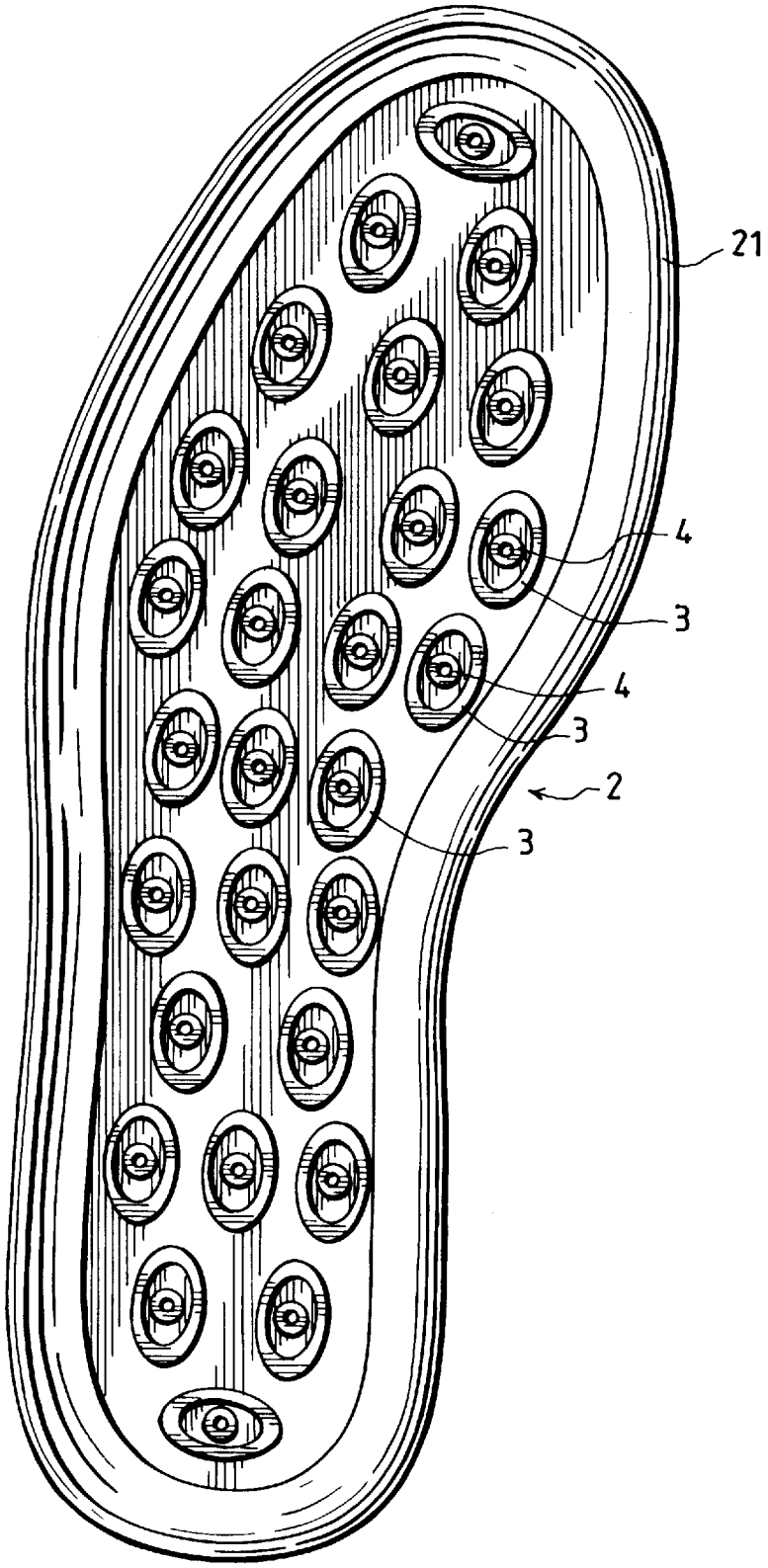
FIG. 3 is a top view of a first preferred embodiment of the present invention applied to a shoe outsole.
Figure 4:
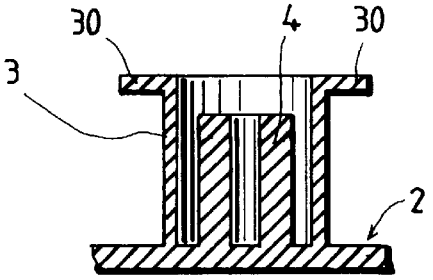
FIG. 4 is a cross sectional view of a portion of FIG. 3.
Figure 5:
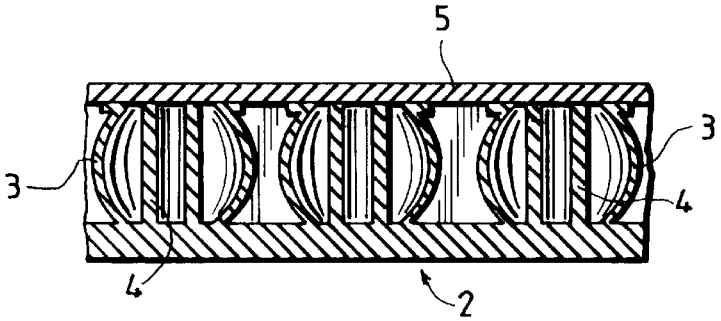
FIGS. 5 and 6 are cross sectional views of a portion of FIG. 3 in use.
Figure 6:
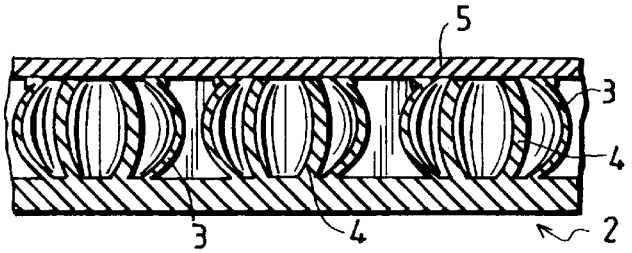

In the first preferred embodiment, referring to FIGS. 3 and 4, the rubber pad construction, which is applied to a shoe sole 2, is shown to comprise a sole substrate 2 with an upper face 21, and a plurality of first and second protrusions 3, 4 which are integrally formed on and project from the upper face 21 at intervals. Each first protrusion 3 is hollow and elliptical and surrounds each second protrusion 4 which is also hollow. The first protrusions 3 have higher and thinner peripheral walls than those of the second protrusions 4, and have outwardly extending flanges which are formed on outer edges thereof to be bonded to a middle sole 5 (with reference to FIG. 5) of a shoe by an adhesive during the shoe making process. When the user's foot depresses the outsole 2, because the second protrusions 4 are not bonded to the middle sole 5, the first protrusions 3 are first deformed easily due to their thinner and higher peripheral walls, thereby providing a shock-absorbing quality. Referring to FIG. 6, the second protrusions 4, which are subsequently depressed, can bear against the pressure, thereby preventing the first protrusions 3 from flexing excessively or yielding and providing a good rebounding effect.

Figure 7:
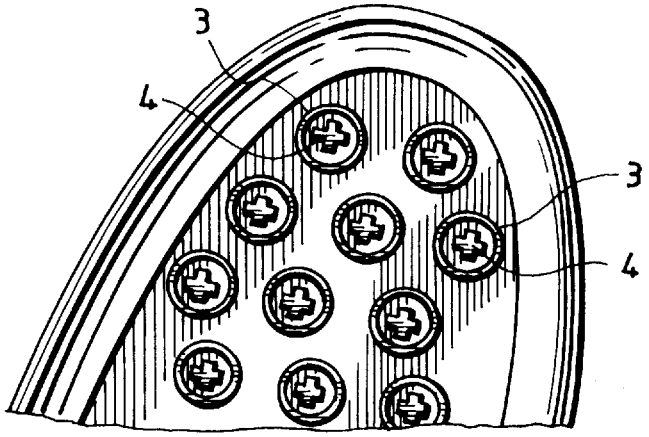
FIG. 7 is a top view of a first modified construction of the first preferred embodiment.

FIG. 7 shows a modified construction of the outsole of the first preferred embodiment. In this construction, the first protrusions 3 are formed as circular tubes. The second protrusions 4 are solid and have a cross-shaped cross-section.

Figure 8:
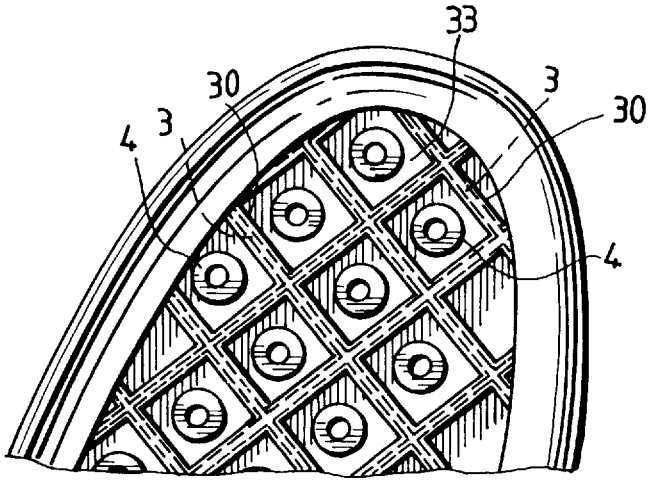
FIG. 8 is a top view of a second modified construction of the first preferred embodiment.

FIG. 8 shows a second modified construction of the outsole of the first preferred embodiment, wherein the first protrusions 3 are formed as intersecting projecting walls 31 which confine a plurality of cavities 33. Each second protrusion 4 is in the form of a circular tube arranged inside each cavity 33. In addition, each projecting wall 31 has an extending flange 30 which is formed on an upper edge thereof.

Figure 9:
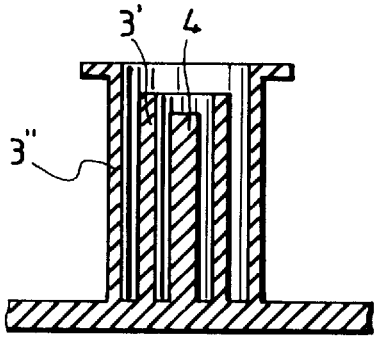
FIG. 9 is a cross sectional view of a third modified construction of the first preferred embodiment.

FIG. 9 shows a third modified construction of the outsole of the first preferred embodiment. In this modification, each second protrusion 4 is in the form of a solid cylinder. Each first protrusion 3 includes an inner tube 3' which surrounds the respective second protrusion 4, and an outer tube 3" which surrounds the inner tube 3'. The outer tube 3" is higher and thinner than the inner tube 3', thereby providing a two-stage shock-absorbing effect.

Figure 10:
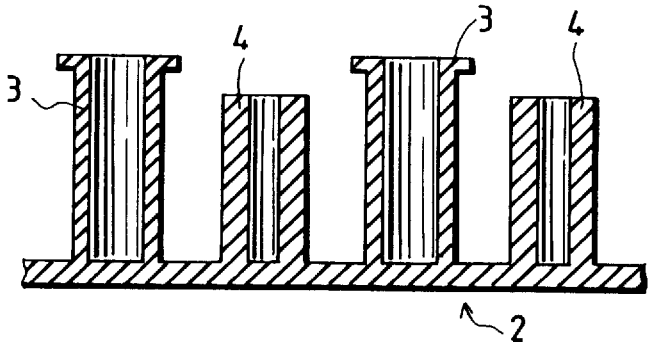
FIG. 10 is a cross sectional view of a fourth modified construction of the first preferred embodiment.

As an alternative, with reference to FIG. 10, the first and second protrusions 3, 4 may be alternatingly formed on the outsole 21.

Figure 11:
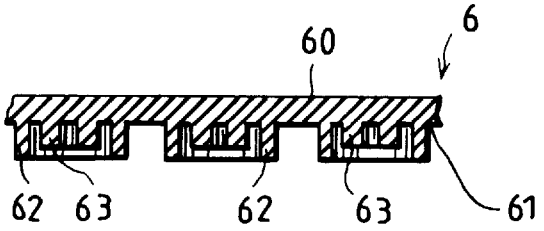
FIG. 11 is a cross sectional view of a second preferred embodiment of the present invention applied to a shoe pad.

As shown in FIG. 11, the rubber pad construction according to the present invention is applied to a shoe pad which has a substrate 6 with a flat upper face 60 to be in contact with the user's foot. A lower face 61 is formed integrally with a plurality of first and second hollow protrusions 62, 63 extending downwardly from the lower face 61 in a manner similar to that shown in FIG. 4, except for the lack of extending flanges of the first protrusions, thereby achieving comfort in walking and sports. More shock-absorbing and rebounding effects can be achieved when the outsole 2 of the first preferred embodiment and the shoe pad 6 of this embodiment are used together in the same shoe.

Figure 12:
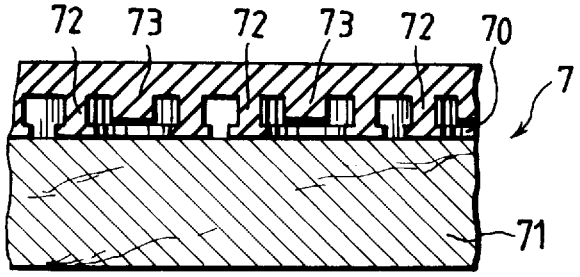
FIG. 12 is a cross sectional view of a third preferred embodiment applied to a table-tennis paddle.

Referring to FIG. 12, a rubber pad substrate 70 has an inner side which is adhered to a wooden board 71 of a table-tennis paddle 7. The inner side of the rubber pad substrate 70 has a plurality of hollow first protrusions 72 and a plurality of solid second protrusions 73 which are formed inside the respective first protrusion 72. The first protrusions 72 are thinner and higher than the second protrusions 73 to provide both shock-absorbing and rebounding qualities. No sponge layer is needed between the board 71 and the rubber pad 70, thereby simplifying the manufacturing of a table-tennis paddle.

Figure 13:
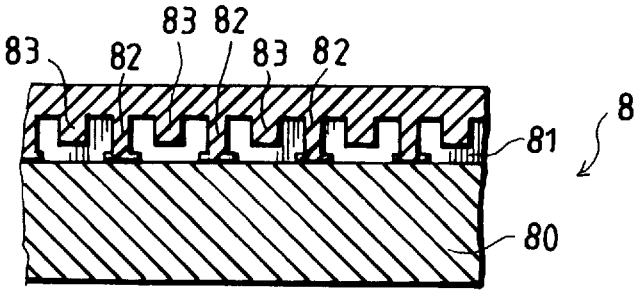
FIG. 13 is a cross sectional view of a fourth preferred embodiment applied to a basketball.

Referring to FIG. 13, the rubber pad construction of the present invention is applied to an outer shell of a basketball or a soccer ball. The inner face of a substrate 81, which has a plurality of thinner first protrusions 82, is adhered to a bladder 80 of a ball 8. A plurality of thicker second protrusions 83 are formed inside the respective first protrusion 82. When the ball 8 hits the user's body, for example, when catching the ball 8, the pain that is felt can be decreased by virtue of the first protrusions 82. The ball 8 can bounce rapidly by virtue of the second protrusions 83.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A rubber pad construction for a shoe, comprising a one-piece molded rubber substrate having a plurality of pairs of concentrically arranged outer taller and inner shorter protrusions which are formed unitarily with said substrate at intervals, said taller and shorter protrusions in each pair having tubular walls which extend substantially perpendicularly from said substrate and which are spaced apart radially from one another in all radial directions, thereby enabling said taller tubular protrusions to deform independently of said shorter tubular protrusions.

2. The rubber pad construction as claimed in claim 1, wherein each of said taller tubular protrusions is provided with a respective outwardly extending annular flange formed on a free end thereof.

3. The rubber pad construction as claimed in claim 1, wherein the walls of the taller protrusions are thinner than the walls of the shorter protrusions.

* * * * *